United States Patent [19]

Tanaka

[11] 4,003,545

[45] Jan. 18, 1977

[54] CORE MEANS HAVING A RUBBER LINER

[75] Inventor: Minoru Tanaka, 148 Nemoto, Matsudo, Chiba, Japan

[22] Filed: Sept. 13, 1974

[21] Appl. No.: 505,922

[30] Foreign Application Priority Data

Sept. 21, 1973 Japan ..... 48-105876

[52] U.S. Cl. ..... 249/112; 249/153; 249/179; 249/183

[51] Int. Cl.[2] ..... B28B 7/36

[58] Field of Search ..... 249/63–65, 249/112, 146, 150, 152–153, 177–179, 183–184; 425/DIG. 44, 468; 264/334

[56] References Cited

UNITED STATES PATENTS

| | | | |
|---|---|---|---|
| 744,970 | 11/1903 | Miller | 249/146 |
| 790,183 | 5/1905 | Campbell | 425/441 |
| 795,518 | 6/1905 | Lamp | 249/152 |
| 799,048 | 9/1905 | Head | 249/63 |
| 1,076,229 | 10/1913 | Priest | 249/112 |
| 1,365,753 | 1/1921 | Vought | 249/112 |
| 1,556,869 | 10/1925 | Murray | 249/63 |
| 2,261,247 | 11/1941 | Girard | 249/183 |
| 2,865,078 | 12/1958 | Hasselblad | 425/DIG. 44 |
| 3,050,786 | 8/1962 | St. John et al. | 264/229 |
| 3,437,309 | 4/1969 | Tausanovitch | 249/43 |
| 3,458,908 | 8/1969 | Burchett | 249/144 |
| 3,561,079 | 2/1971 | Anderson | 264/314 |

FOREIGN PATENTS OR APPLICATIONS

| | | | |
|---|---|---|---|
| 1,314 | 11/1898 | United Kingdom | 249/152 |

*Primary Examiner*—Richard B. Lazarus
*Assistant Examiner*—John McQuade
*Attorney, Agent, or Firm*—Anthony A. O'Brien

[57] ABSTRACT

A core member used in a moulding flask for making prefabricated concrete products, comprising a hollow tubular member of predetermined size having all outer surfaces intended to be in contact with concrete mixture covered by a thin layer of rubber plate.

2 Claims, 14 Drawing Figures

CORE MEANS HAVING A RUBBER LINER

The present invention relates to a core member used in a moulding flask, and more particularly relates to a core member easily removable from a prefabricated concrete product formed in a moulding flask.

In the prior art, wooden or metallic core members of separable type have been used for making hollow tubular prefabricated concrete products. The wooden core member requires a great deal of labor for fabrication and moreover is destroyed almost each time it is removed from the prefabricated concrete products, and hence is not economical in terms of material and labor. The metallic core member of separable type may be used many times repeatedly, but requires a considerable time and labor for assemblying and dismantling. The present invention is devised to eliminate disadvantages of conventional core members used in the moulding flask for making prefabricated concrete blocks or products as described hereinabove.

It is object of the present invention to provide economical core members for making prefabricated concrete products easily removable from prefabricated concrete products and capable of being used repeatedly without spending material and labor in the assemblying and dismantling process.

According to the present invention, there is provided a core device for making a prefabricated concrete product comprising a hollow tubular member and a thin layer of rubber material laid over outer surfaces of said hollow tubular member which is in contact with the concrete mixture when it is poured.

Now, preferable embodiments of the core member according to the present invention will be described in detail hereinafter by way of example with reference to accompanying drawings, in which, FIG. 1 is a vertical section view, showing one embodiment of the core member according to the present invention.

Figure 5:
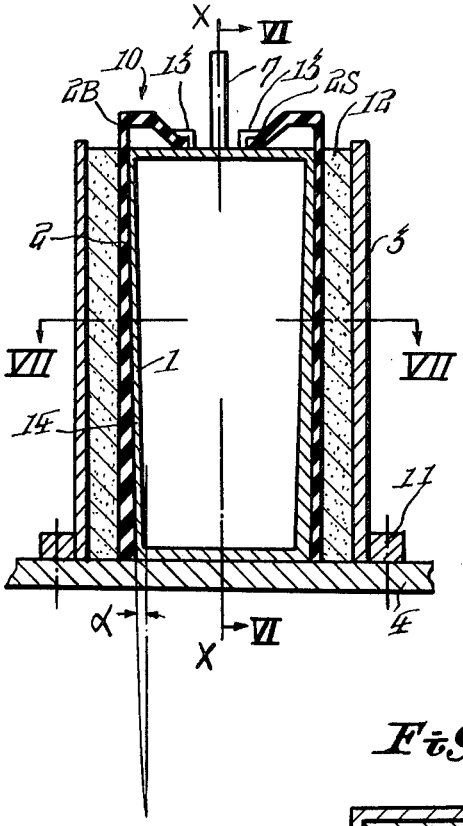
Figure 6:
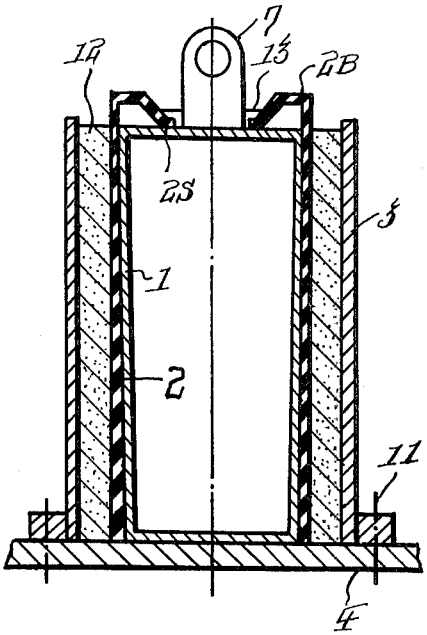
Figure 7:
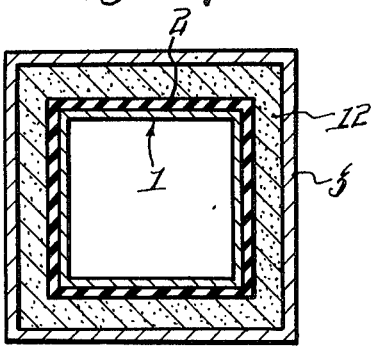
Figure 8:
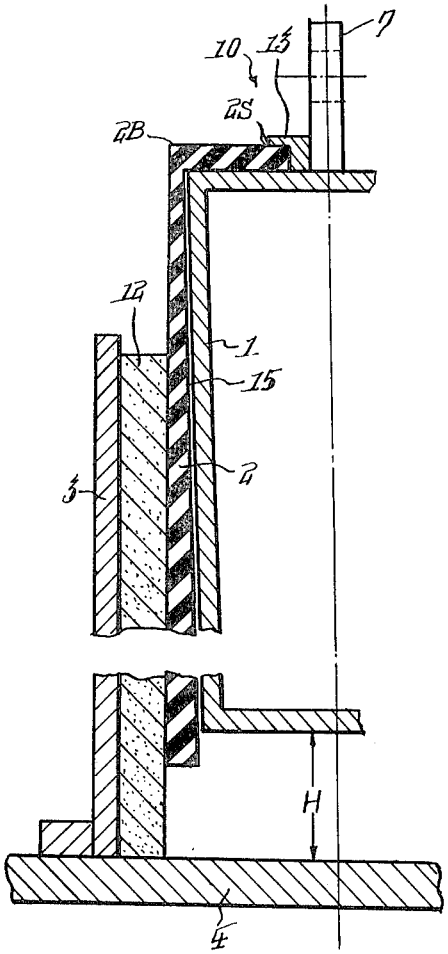
Figure 9:
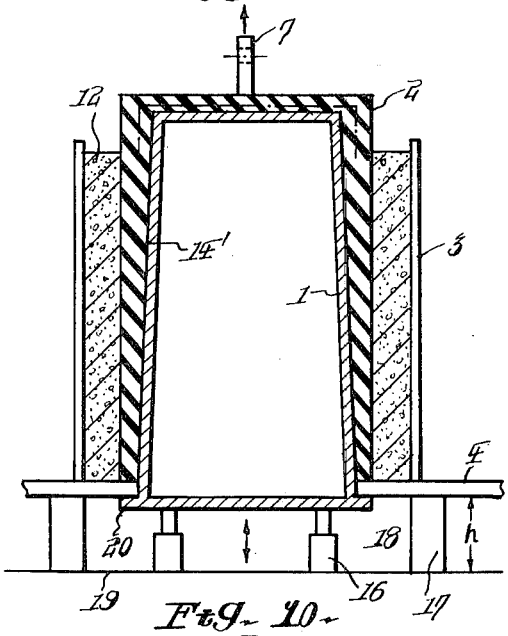
Figure 10:
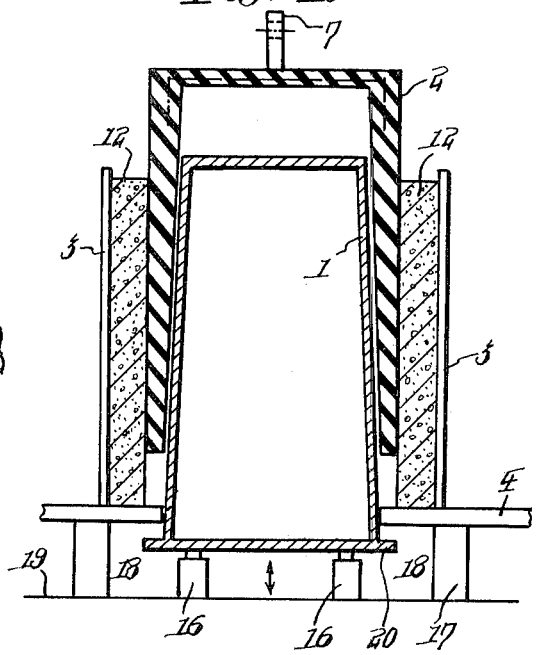
Figure 11:
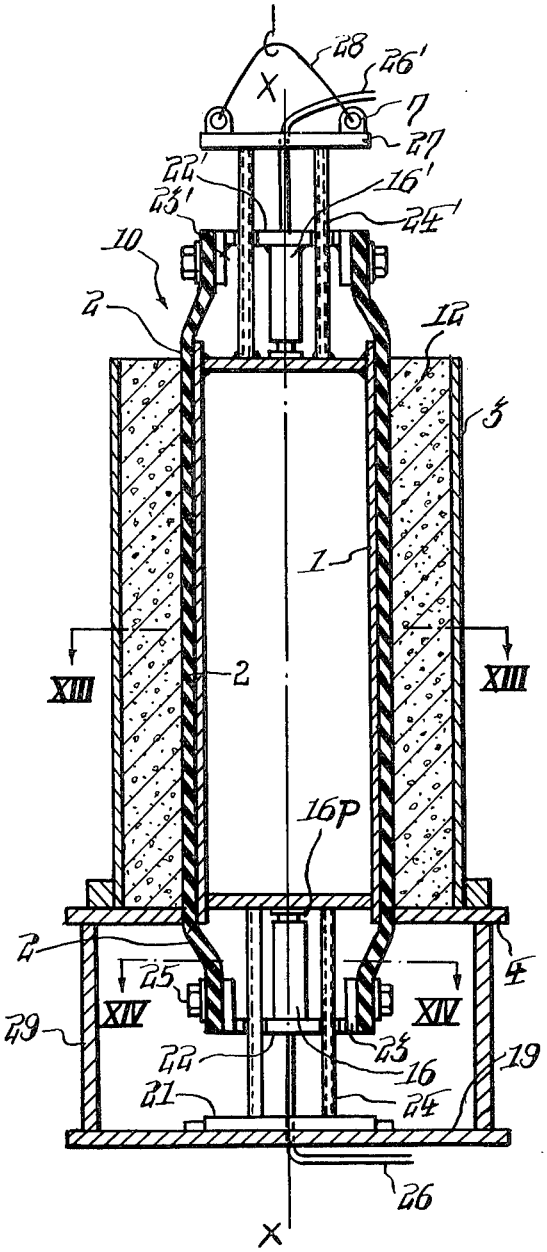
Figure 12:
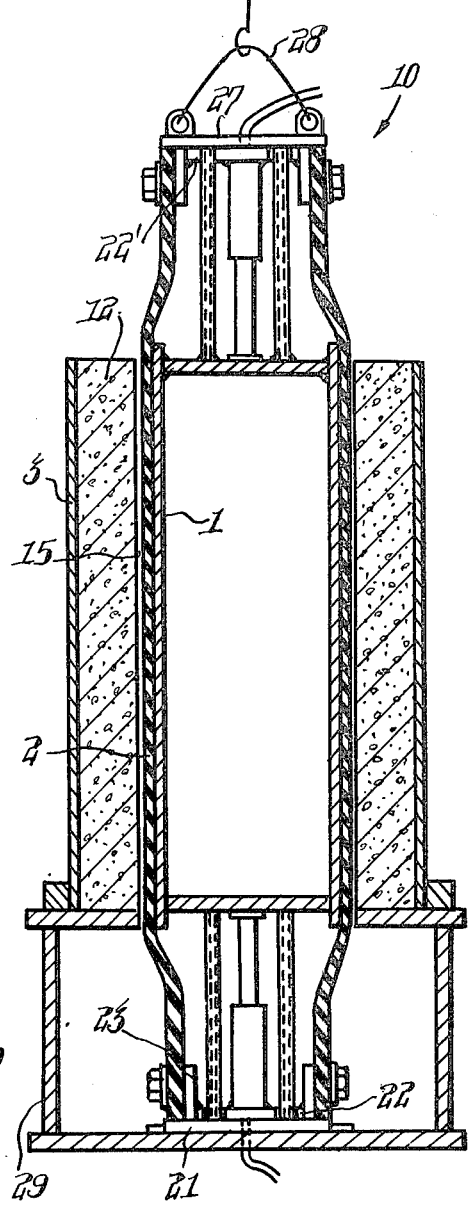
Figure 13:
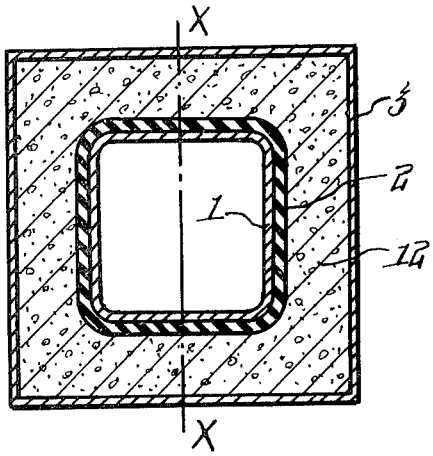
Figure 14:
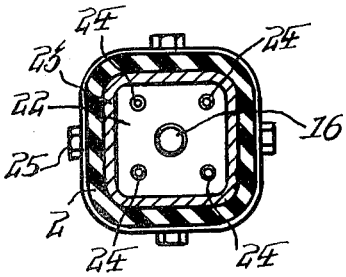

FIG. 5 is a vertical section view showing a modified embodiment of the core member, FIG. 6 is a vertical section view taken on a line VI—VI in FIG. 5, FIG. 7 is a horizontal section view taken on a line VII—VII in FIG. 5, FIG. 8 is a vertical section view showing a dismantling operation of the core member in FIG. 5, FIG. 9 is a vertical section view showing another modified embodiment of the core member, FIG. 10 is a vertical section view showing the dismantling operation of the core member in FIG. 9, FIG. 11 is a vertical section view showing further modified embodiment of the core member, FIG. 12 is a vertical section view showing the dismantling operation of the core member in FIG. 11, FIG. 13 is a horizontal section view taken along a line XIII—XIII in FIG. 11, FIG. 14 is a horizontal section view taken along a line XIV—XIV in FIG. 11.

Figure 1:
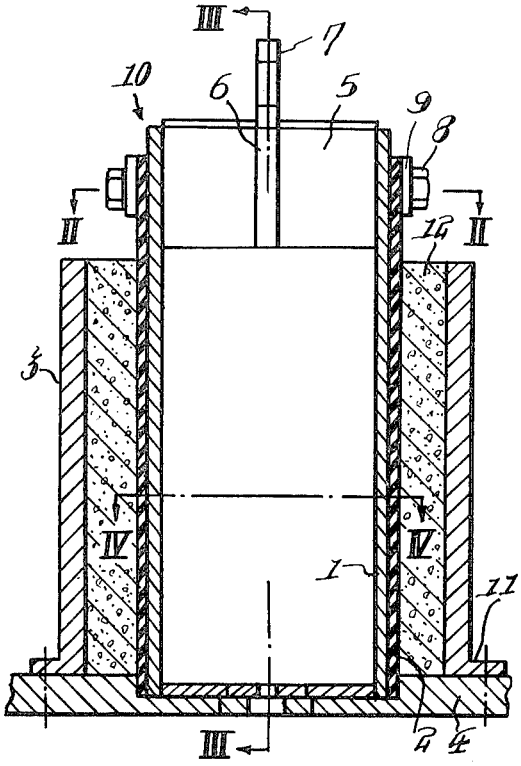
Figure 3:
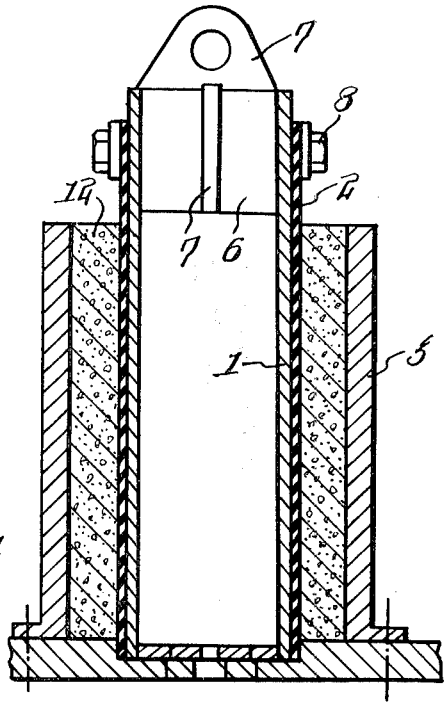
FIG. 3 is a vertical section view, taken along a line III—III in FIG. 1.
Figure 2:
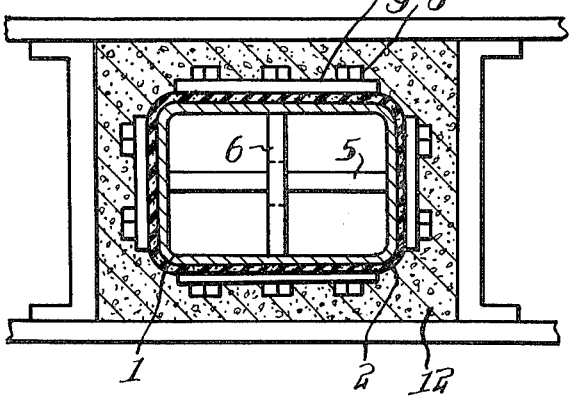
FIG. 2 is a horizontal section view taken along a line II—II in FIG. 1.
Figure 4:
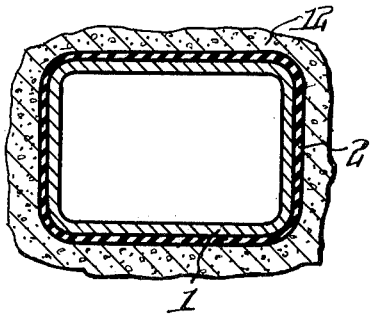
FIG. 4 is a horizontal section view taken along a line IV—IV in FIG. 1.

Referring to FIG. 1, there is shown a core member 10 according to the present invention located within a moulding flask 3 rigged up for making prefabricated concrete blocks and fastened to a bottom plate 4. The core member 10 comprises a hollow tubular member 1 of a rigid metallic or rigid plastic material having a predetermined size and a thin layer 2 of natural or synthetic rubber laid over outer surfaces of the hollow tubular member 1. The thin layer 2 of rubber is fastened to the hollow tubular member 1 along upper edge thereof by means of bolts 8 and washers 9. The tubular member 1 is provided at upper end thereof with ribs 5 and 6, each one of which is placed perpendicularly to the other. An eye plate 7 is mounted on the rib 6.

In operation, the core member 10 according to the present invention is located within the moulding flask 3 is predetermined position and then concrete mixture 12 is poured. When the core member 10 is pulled upwardly after having exercised suitable care for sound curing of the concrete mixture, it is removed very easily from the cured concrete 12 since the thin layer 2 of rubber is in contact with the concrete 12 without any measurable affinity therebetween. Since the thin layer 2 of rubber will be elongated considerably when removing the core member, core removing operation is materially facilitated even though some portion of the thin layer 2 of rubber is stuck on the surface of the concrete block. The core member may be removed much easier if suitable parting agent is applied on the thin layer 2 of rubber before pouring of the concrete mixture. The thin layer 2 of rubber can be replaced readily when it is worn out by repeated usage.

A modified embodiment of the core member according to the present invention is shown in FIG. 5, 6, 7 and 8. The moulding flask 3 is fastened to the bottom plate 4 by means of bolts 11 and the core member 10 is located within the moulding flask 3 in predetermined position. The core member 10 comprises the hollow tubular member 1 of metallic or plastic material having a predetermined size and the thin layer 2 of rubber laid over outer surfaces of the tubular member 1. Socket means 13 of angle material is mounted on top of the tubular member 1 so as to accommodate upper edge portion 2S of the thin layer 2 of rubber. A bent portion 2B, which is located adjacent to the upper edge portion 2S of the thin layer 2, is protruding upwardly from upper end of the tubular member 1 extends radially inwardly and slopes downwardly to the upper edge portion 2S. The tubular member 1 has a truncated conical surface 14 in the outside. Correspondingly, the thin layer 2 of rubber is provided with similar truncated conical surface internally, so as to be closely fitted over the tubular member 1. In this embodiment, the surface 14 has a taper $\alpha$ diverging upwardly along central axis XX of the tubular member 1. The thin layer 2 of rubber has vertical surfaces in the outside where it is in contact with concrete mixture and tapered surfaces in the inside.

FIG. 8 shows a condition of the core member 10 when it is extracted out of the moulding flask 3. Bottom surface of the tubular member 1 is raised from the bottom plate 4 by a height H. In this condition, the bent portion 2B at the upper end of the thin layer 2 of rubber fits over peripheral portion of the tubular member 1 at the upper end, the thin layer 2 of rubber comes downwardly with respect to the tubular member 1 and a gap 15 is produced between the outer surface of the tubular member 1 and the inner surface of the thin layer 2 of rubber. This means that the thin layer 2 of rubber will become separated from the tubular member 1 simply by lifting operation of the latter. When the tubular member 1 is raised further from the condition in FIG. 8, the thin layer 2 of rubber becomes separated from the concrete product 12.

Another modified embodiment of the core member 10 is shown in FIG. 9 and 10. The tubular member 1 has a truncated conical surface 14', which is diverging downwardly, in the outside. The bottom plate 4 is raised to a height h from ground 19 so as to produce a hollow space 18 under the bottom plate 4. The tubular member 1 is supported at its lower end by hydraulic jack means 16 which are located within the hollow space 18.

In pouring position as shown in FIG. 9, the tubular member 1 is fully raised with a bottom flange 20 thereof abutted with the bottom plate 4 by action of the jack means 16. The thin layer 2 of rubber is intimately in contact with the tubular member 1 in this condition. The jack means 16 is released as shown in FIG. 10 when it is desired to dismantle the core member 10 after the concrete is cured. The tubular member 1 will be separated very easily from the thin layer 2 of rubber, since the tubular member 1 comes downwardly by gravity. At this time, the thin layer 2 of rubber may be temporarily withheld by using suitable means such as a crane. Since the thin layer 2 of rubber is separated very easily from the surface of concrete, dismantling operation of the core member 10 will be facilitated.

Further modified embodiment of the core member according to the present invention is shown in FIG. 11, 12, 13 and 14. The core member 10 is placed within the moulding flask 3 which is bolted to the bottom plate 4. The core member 10 includes the hollow tubular member 1 and the thin layer 2 of rubber laid over the tubular member 1. The thin layer 2 of rubber is fitted over the tubular member 1 such that the former will extend and contract in a direction of central axis XX of the tubular member 1.

The bottom plate 4 is raised from a floor plate 21 to the predetermined height by means of a vertical support member 29. The thin layer 2 of rubber has its lower end of reduced size extended beyond the tubular member 1.

A square plate 22 having a vertical ring-shaped flange 23 upstanding from peripheral portion thereof is inserted into the thin layer 2 of rubber at its lower end and fastened thereto by bolt means 25. A hydraulic jack 16 is located on top of the square plate 22. A piston member 16P of the hydraulic jack 16 is connected to the lower end of the tubular member 1. Four vertical guide rods 24 slidably passing through the square plate 22 adjacent to four corners have their upper ends secured to the lower end of the tubular member 1 and lower ends connected to a seating plate 21 placed on top the floor plate 19. A hose 26 connects the hydraulic jack 16 to suitable oil source (not shown).

Another square plate 22' similar to the square plate 22 described hereinabove is secured to the thin layer 2 of rubber at its upper end. Another hydraulic jack means 16' is located between lower surface of the square plate 22' and the upper end of the tubular member 1. Four guide rods 24' slidably passing through the square plate 22' have their lower ends secured to the upper end of the tubular member 1 and their upper ends connected to a common horizontal stopper plate 27. An oil supply hose 26' is connected to the jack means 16'.

In operation, pouring of the concrete mixture is carried out in a condition of FIG. 11, wherein the lower square plate 22 is raised and the upper square plate 22' is lowered thereby causing the thin layer 2 of rubber to be laid over the tubular member 1 without any elongation in the direction of XX. When the concrete 12 is cured, both jack means 16, 16' are operated so as to descend the lower square plate 22 down to a level of the seating plate 21 and raise the upper square plate 22' up to the horizontal stopper plate 27 until a condition in FIG. 12 is attained. In this condition, the thin layer 2 of rubber is elongated in a direction of XX and consequently its thickness becomes reduced considerably, thereby causing the thin layer 2 of rubber to be easily separated from the concrete 12. The core member 10 may be easily dismantled from the moulding flask 3 by using a suitable crane connected to a sling wire 28. The thin layer 2 of rubber may be brought back to original condition of FIG. 11 for next operation by manipulating the jack means 16, 16'.

Although a pair of jack means 16, 16' are provided on the tubular member 1 at both ends thereof in the embodiment described hereinabove, it is understood that the core member 10 will function substantially in the same manner in case of the thin layer 2 of rubber being subjected to elongation only at one end with the other end fixed.

According to the present invention, the core member 10 will become separated from the concrete only by elongation of the thin layer 2 of rubber. Moreover, the thin layer 2 of rubber is laid over the tubular member 3 at all times without being separated from the latter. Hence, a mould handling process in concrete prefabricating operation will become simplified considerably.

I claim:

1. A core device used in a moulding flask for making prefabricated concrete product, said device comprising
   - a hollow tubular member formed from a rigid material and having an outer surface,
   - a thin layer of rubber freely laid over the outer surface of said hollow tubular member,
   - said thin layer of rubber having an outer surface for engaging and retaining concrete mixture poured into said moulding flask,
   - said outer surface of the hollow tubular member being a truncated conical surface diverging toward the upper end of the tubular member,
   - said thin layer of rubber having an inside surface which is a truncated conical surface diverging toward the upper end of the tubular member so as to mate with the outer surface of the hollow tubular member, and
   - further said thin layer being secured at its upper edge portion to the top of the tubular member and having a bent portion protruding above the upper end of the tubular member, extending radially inwardly, and sloping downwardly to the upper edge portion of the thin layer of rubber.

2. A core device used in a moulding flask for making prefabricated concrete product, said device comprising
   - a hollow tubular member formed from a rigid material and having an outer surface,
   - a thin tubular layer of rubber freely laid over the outer surface of the hollow tubular member,
   - said thin layer of rubber having an outer surface for engaging and retaining concrete mixture poured into said moulding flask,
   - a pair of movable plates attached to the respective opposite ends of the thin layer of rubber, and
   - a pair of jack means attached to the respective pair of plates and the respective opposite ends of the hollow tubular member for elongating the thin layer of rubber.

* * * * *